US009417577B2

(12) United States Patent
Yamanaka

(10) Patent No.: US 9,417,577 B2
(45) Date of Patent: Aug. 16, 2016

(54) FIXING DEVICE AND IMAGE FORMING APPARATUS

(71) Applicant: KYOCERA Document Solutions Inc., Osaka (JP)

(72) Inventor: Tatsuya Yamanaka, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/878,185

(22) Filed: Oct. 8, 2015

(65) Prior Publication Data

US 2016/0109837 A1 Apr. 21, 2016

(30) Foreign Application Priority Data

Oct. 20, 2014 (JP) ..... 2014-213888

(51) Int. Cl.
*G03G 15/20* (2006.01)

(52) U.S. Cl.
CPC ..... *G03G 15/2064* (2013.01)

(58) Field of Classification Search
CPC combination set(s) only.
See application file for complete search history.

(56) References Cited

U.S. PATENT DOCUMENTS 5,732,309 A * 3/1998 Okuno ..... G03G 15/2064 399/320
7,526,242 B2 4/2009 Takagaki et al.
2007/0065188 A1 3/2007 Takagaki et al.
2015/0261151 A1* 9/2015 Ishigaya ..... G03G 15/2039 399/33

FOREIGN PATENT DOCUMENTS

JP 2008-040437 A 2/2008

* cited by examiner

*Primary Examiner* — Clayton E Laballe
*Assistant Examiner* — Jas Sanghera

(57) ABSTRACT

A fixing device includes a heat source, a heat transfer member, a pressure-contacting member, a housing, and a shutter. The heat transfer member is heated by the heat source. The pressure-contacting member abuts on the heat transfer member. The housing stores the heat transfer member and the pressure-contacting member and is formed with a detection hole for detecting inner property from outside. The fixing device heats recording paper passing through between the heat transfer member and the pressure-contacting member to fix a toner image on the recording paper. The shutter opens and closes the detection hole in accordance with supply of the recording paper to a nip part by the heat transfer member and the pressure-contacting member.

7 Claims, 8 Drawing Sheets

2

2

2

FIXING DEVICE AND IMAGE FORMING APPARATUS

INCORPORATION BY REFERENCE

This application claims priority to Japanese Patent Application No.2014-213888 filed on Oct. 20, 2014, the entire contents of which are incorporated by reference herein.

BACKGROUND

This disclosure relates to a fixing device having a detection hole for detecting an inner state from outside and an image forming apparatus provided with such a fixing device.

There has been a fixing device including, in a housing, a heat source, a heat transfer member heated by the heat source, and a pressure-contacting member pressure-contacting the heat transfer member, which heats recording paper passing through between the heat transfer member and the pressure-contacting member to fix a toner image on the recording paper.

For example, there has been a fixing device having a detection hole provided in the housing, measuring through the detection hole a temperature of the heat transfer member at time of fixation by a temperature sensor arranged outside of the fixing device.

SUMMARY

As one aspect of this disclosure, a technology obtained by further improving the technology described above will be suggested.

A fixing device according to one aspect of this disclosure includes: a heat source, a heat transfer member, a pressure-contacting member, a housing, and a shutter.

The heat transfer member is heated by the heat source.

The pressure-contacting member being in pressure-contact with the heat transfer member.

The housing stores the heat transfer member and the pressure-contacting member, and is formed with a detection hole for detecting inner property from outside.

The fixing device heats recording paper passing through between the heat transfer member and the pressure-contacting member to fix a toner image on the recording paper.

The shutter opens and closes the detection hole in accordance with supply of the recording paper to a nip part by the heat transfer member and the pressure-contacting member.

DETAILED DESCRIPTION

Embodiment

Hereinafter, the embodiment of a fixing device according to one mode of this disclosure and an image forming apparatus provided with such a fixing device will be described with reference to the drawings.

1. Outline of Image Forming Apparatus

Figure 1A:
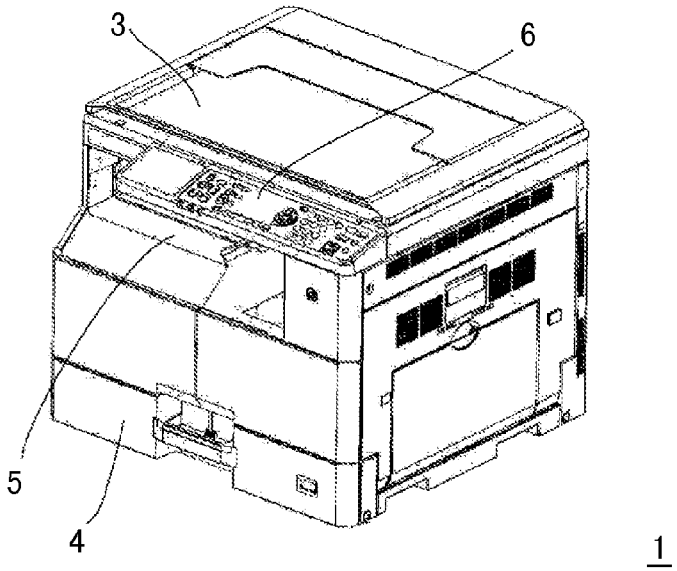
FIG. 1A is a perspective view of an image forming apparatus according to an embodiment.
Figure 1B:
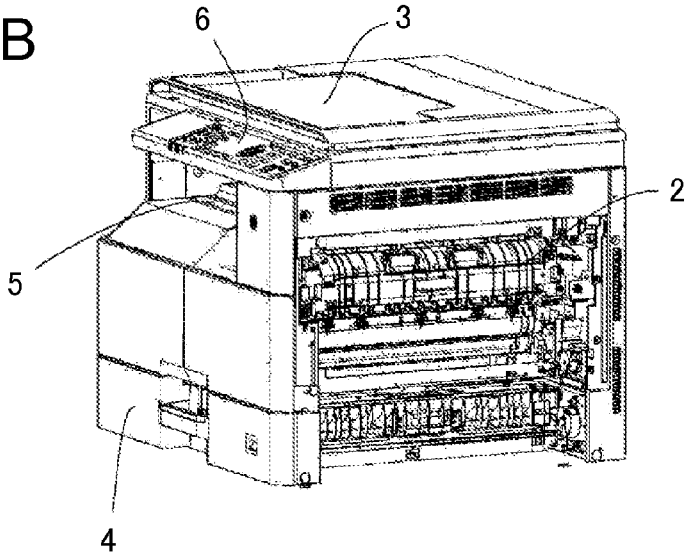
FIG. 1B is a perspective view of the image forming apparatus with a side cover removed.
Figure 2A:
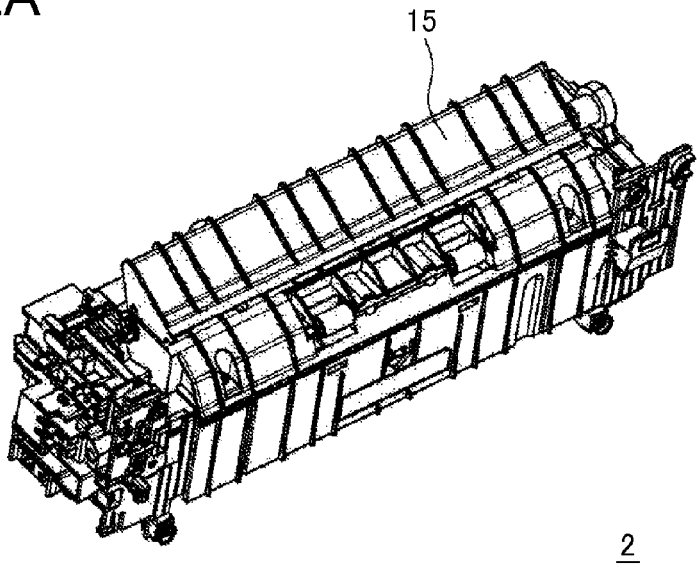
FIGS. 2A and 2B are perspective views of a fixing device.
Figure 2B:
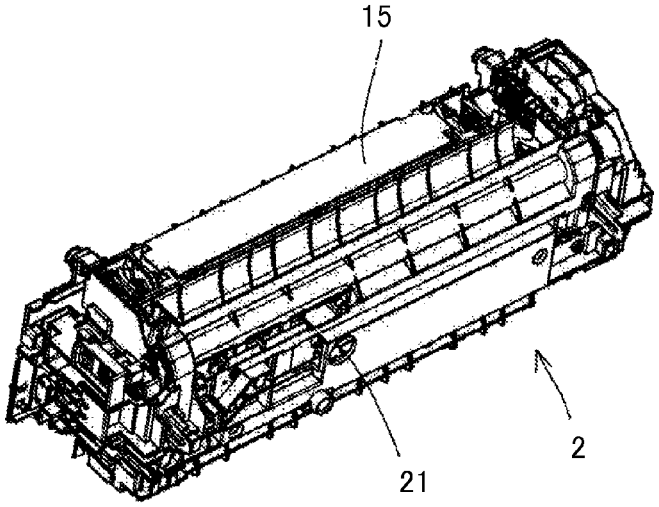
Figure 3:
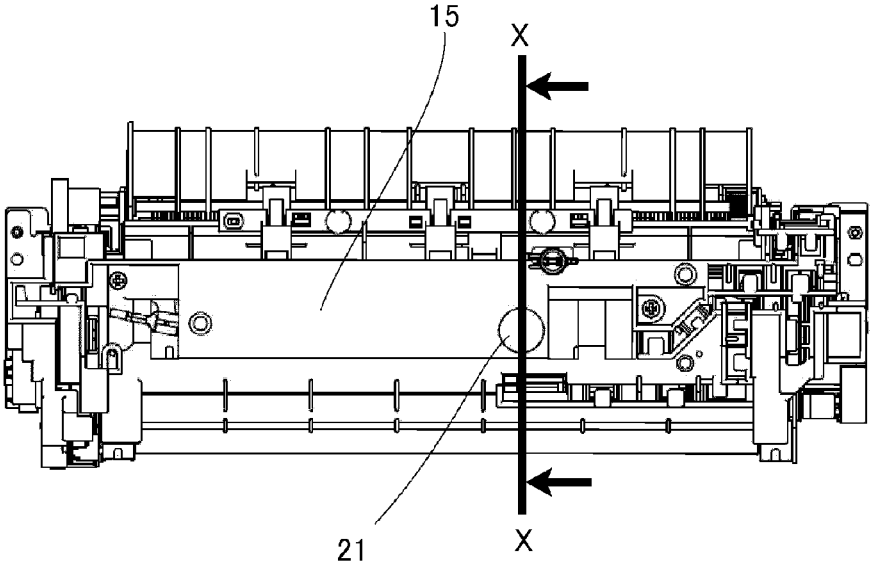
FIG. 3 is a view of the fixing device from a detection hole side.

The image forming apparatus 1, as shown in FIG. 1, includes: for example, an image formation section (not shown) which forms a toner image on recording paper; a fixing section 2 which fixes the formed toner image; a detection sensor which detects inner property of the fixing section 2; and a control section which, based on the detected property, controls property of the fixing section 2. The fixing section 2 has a detection hole for the property detection, and this detection hole is used to achieve the property detection performed by the detection sensor.

The image forming apparatus 1 includes: in addition to the aforementioned image formation section, fixing section 2, and detection sensor, for example, an image reading section which reads an image of a set original document; a paper feed section 4 which supplies recording paper to the image formation section; a discharge section which discharges, to a discharge tray 5, the recording paper on which the toner image has been fixed; an operation display section 6 for displaying various functions, and for operating selection of various functions, etc.; and a main control section which controls the various sections for the purpose of executing the selected function.

Here, the image reading section is covered with an original document cover 3. Moreover, a control section which controls the property of the fixing section may be incorporated in the main control section or may be provided separately from the main control section.

2. Fixing Section

The fixing section 2 corresponds to one example of the fixing device according to this disclosure, and is incorporated as a fixing section which forms a part of the image forming apparatus. Hereinafter, the fixing section is described as the fixing device.

Figure 4:
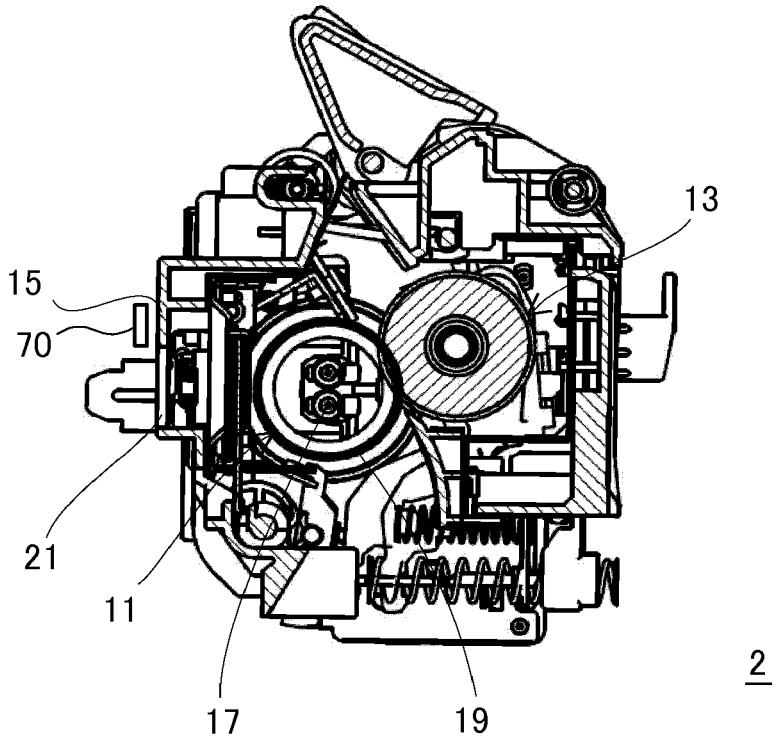
FIG. 4 is a view of a cross section taken along line X-X of FIG. 3 from a direction of an arrow.
Figure 5A:
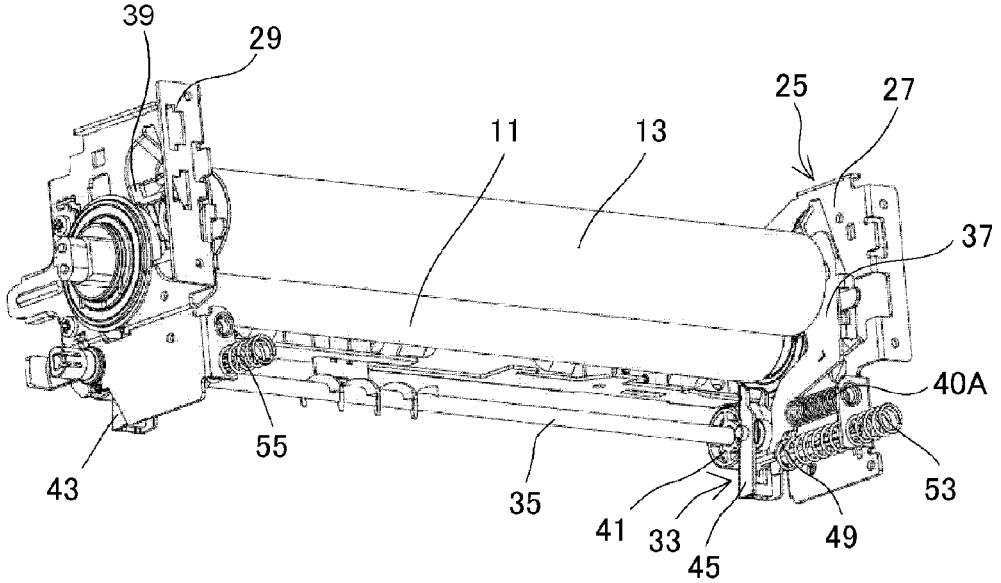
FIGS. 5A and 5B are perspective views showing a state of inside of the fixing device while the detection hole is closed.
Figure 5B:
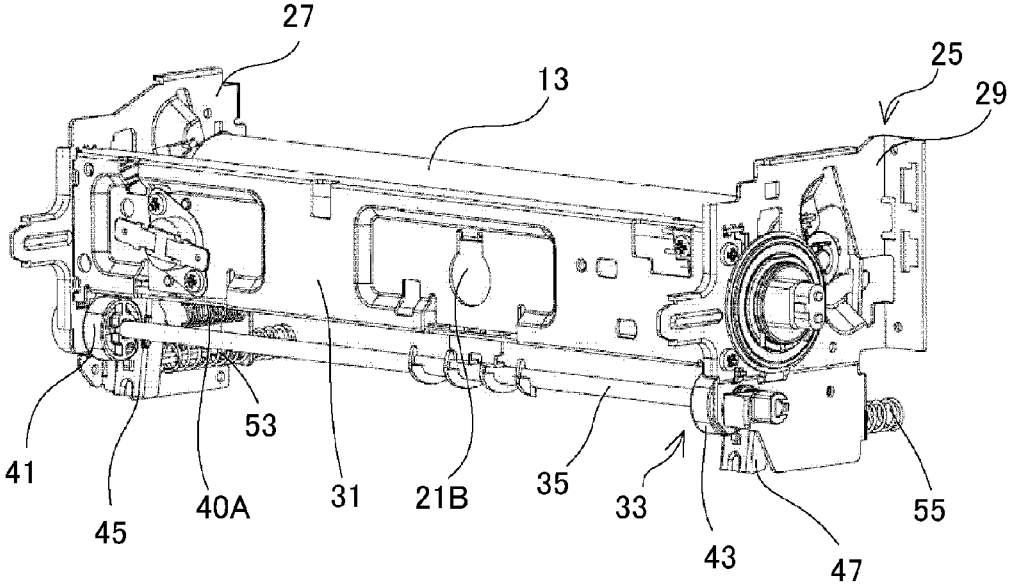
Figure 6A:
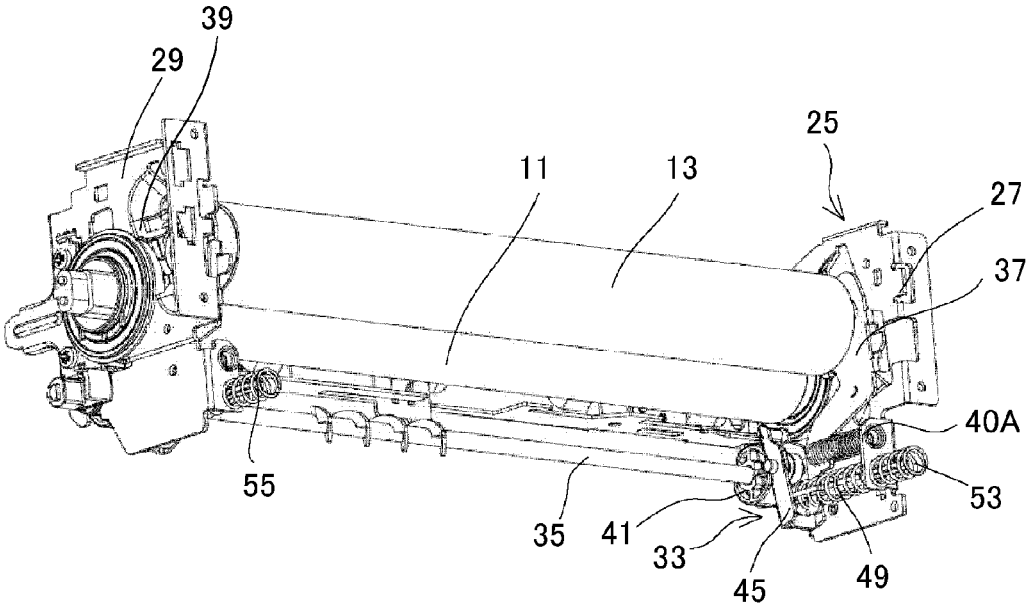
FIGS. 6A and 6B are perspective views showing a state of the inside of the fixing device while the detection hole is open.
Figure 6B:
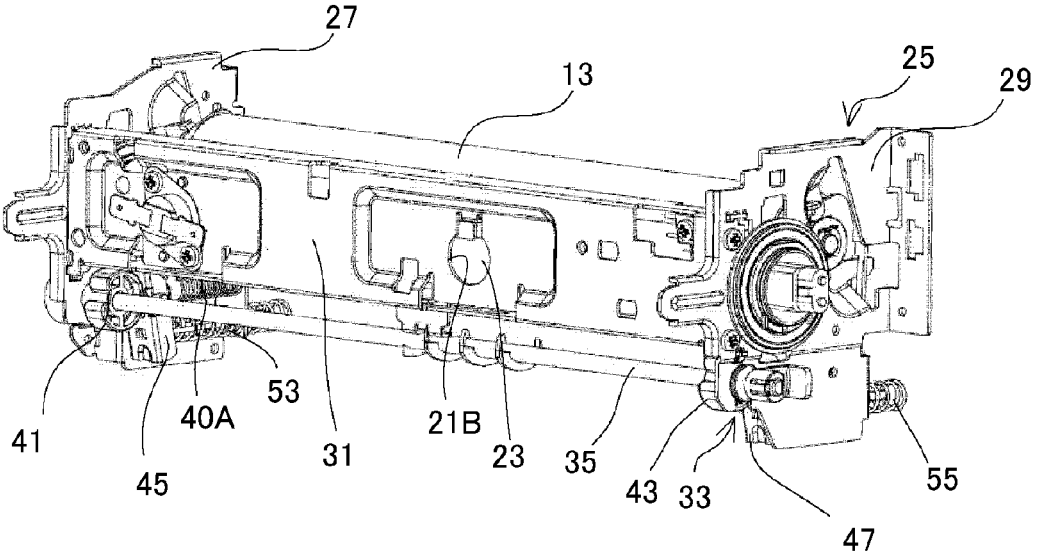

The fixing section 2, as shown in FIGS. 2A through 4, particularly in FIG. 4, a heat roller 11 and a press roller 13 are included in a housing 15. The heat roller 11 corresponds to one example of a combination of a heat source according to this disclosure and a heat transfer member according to this disclosure. The press roller 13 corresponds to one example of a pressure-contacting member according to this disclosure. The press roller 13 makes pressure-contact with the heat roller 11.

Here, a halogen lamp 17 is used as the heat source, and a roller 19 is used as the heat transfer member. The halogen lamp 17 is inserted inside the roller 19.

The fixing section 2 heats the recording paper passing through between the heat roller 11 and the press roller 13 (hereinafter referred to as "nip part") to fix the toner image on the recording paper.

The fixing section 2 has, in the housing 15, a detection hole 21 for detecting the inner property from outside, and includes a shutter 23 which opens and closes the detection hole 21 in accordance with supply of the recording paper to the nip part. Here, the inner property of the fixing section 2 is a temperature of the heat roller 11.

The fixing section 2, as shown in FIGS. 5A, 5B, 6A, and 6B, includes a frame 25 which rotationally supports the heat roller 11. The frame 25 has: side plates 27 and 29 arranged at both ends in a direction in which an axis of the heat roller 11 extends (hereinafter, the extending direction and a direction parallel to the extending direction are referred to "axial direction"); and a coupling plate 31 coupling together the pair of the side plates 27 and 29.

Figure 8A:
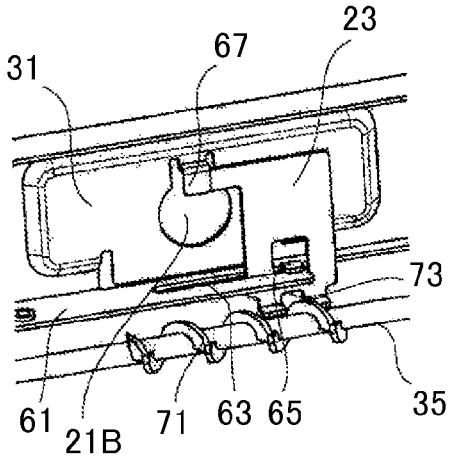
FIGS. 8A and 8B are perspective views showing states in which the detection hole is opened and closed, respectively.
Figure 8B:
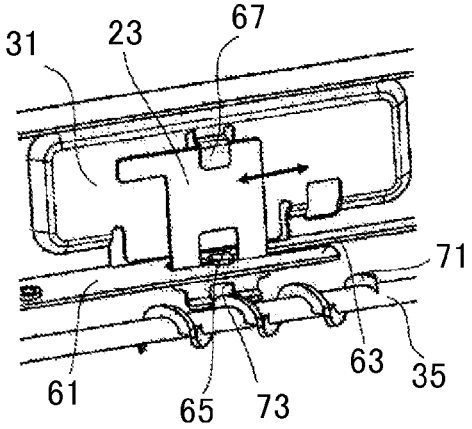

The coupling plate 31 is provided with a detection hole 21B at a position corresponding to the detection hole 21 of the housing 15. The shutter 23 opens the detection hole 21B upon supply of the recording paper as shown in FIG. 8A, and closes the detection hole 21B upon discharge of the recording paper as shown in FIG. 8B. Note that the closing of the detection hole 21B also closes the detection hole 21 of the housing 15. The opening of the detection hole 21B also opens the detection hole 21 of the housing 15.

Moreover, disposed outside of the housing 15, for example, at a position opposing the detection hole 21B is a temperature sensor 70 (see FIG. 4). The temperature sensor 70 detects the temperature of the heat roller 11 stored in the housing 15. That is, the property described above is the temperature of the heat roller 11 here. The temperature sensor 70 detects, through the detection hole 21B being opened by the shutter 23, a temperature of the housing 15, for example, the temperature of the heat roller 11 stored in the housing 15.

The fixing device 2 includes a pressing part 33 which, in accordance with the supply of the recording paper to the nip part, presses the press roller 13 against the heat roller 11 as shown in FIGS. 5A through 7B, and the opening and closing of the shutter 23 is interlocking with the operations of the pressing part 33.

The pressing part 33 at least has: a rotary shaft 35 which rotates in accordance with the supply of the recording paper; and a pair of moving members 37 and 39 which are fitted with the press roller 13. Note that the moving member 39 is provided at the side plate 29, and is hidden by the side plate 29 in FIGS. 5A, 5B, 6A, and 6B. The moving members 37 and 39, in accordance with the rotation of the rotary shaft 35, move in an approaching and separating direction in which the press roller 13 approaches to and separates from the heat roller 11. The shutter 23 opens and closes the detection hole 21B in accordance with the rotation of the rotary shaft 35.

The pressing part 33 is provided at the frame 25. More specifically, the moving members 37 and 39 and the rotary shaft 35 of the pressing part 33 are provided at the side plates 27 and 29. Note that the rotary shaft 35 is driven into rotation by a motor, not shown, in accordance with the supply of the recording paper.

Figure 7A:
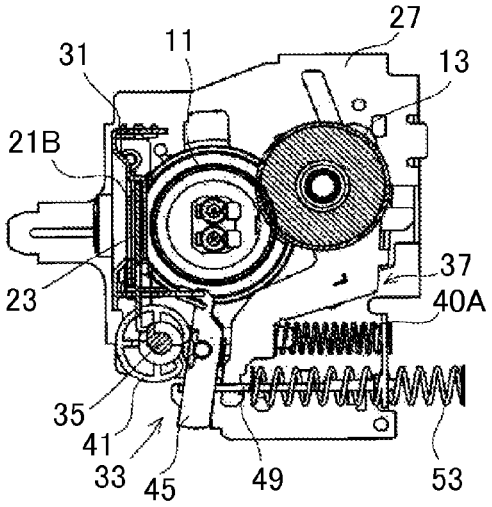
FIG. 7A is a sectional view of a state in which a press roller presses a heat roller.
Figure 7B:
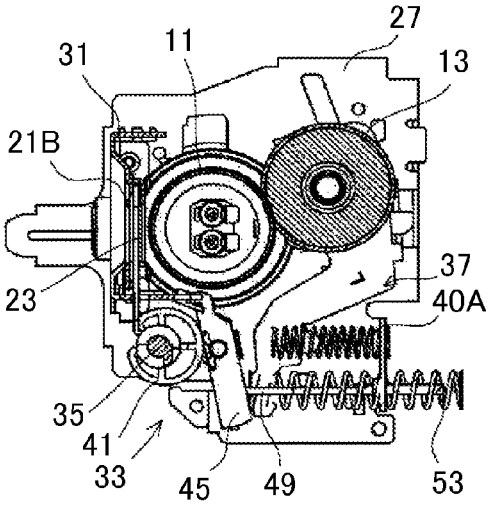
FIG. 7B is a sectional view of a state in which the press roller does not press the heat roller.

The moving members 37 and 39, as shown in FIGS. 7A and 7B, are "L"-shaped when viewed from the axial direction of the heat roller 11. Portions located on one side forming the "L" (portions located higher than the axis of the press roller 13 although they are invisible by being hidden by a shade of the press roller 13 in FIGS. 7A and 7B) are fixed at the side plates 27 and 29 in a manner such as to be rotatable (oscillatable) around an axis passing through these portions (the portions which are fixed are defined as fixed portions).

The press roller 13 is rotationally fitted at a position away from the fixed portions of the moving members 37 and 39. In other words, the moving members 37 and 39 oscillate (move) with respect to the fixing portions as a center whereby the press roller 13 approaches to and separates from the heat roller 11.

The pressing part 33 brings, more closely to the heat roller 11, portions located closer to the press roller 13 than the fixation portions in the moving members 37 and 39 while the press roller 13 is in contact with the heat roller 11, whereby the press roller 13 presses the heat roller 11.

The pressing part 33 may further have a function of adjusting, depending on a thickness of the recording paper, an amount of pressing the heat roller 11 by the press roller 13. For example, the pressing part 33 presses the pressure-contacting member against the heat transfer member described above by a pressing amount predefined in accordance with a thickness of the recording paper. More specifically, the pressing part 33 may have a load generating member which generates such a load that presses the press roller 13 against the heat roller 11. This load generating member corresponds to compression springs 40A and 40B. The compression spring 40B is provided at the side plate 29, and is hidden by the side plate 29 in FIGS. 5A, 5B, 6A, and 6B.

The pressing part 33 further has cams 41 and 43 fitted to the rotary shaft 35, and the moving members 37 and 39 move by interlocking with operation of the cams 41 and 43. More specifically, the pressing part 33, as shown in FIGS. 5A through 7B, includes: oscillating members 45 and 47 which oscillate while abutting on outer circumferential surfaces of the cams 41 and 43; and coupling members 49 and 51 which couple the oscillating members 45 and 47 to the moving members 37 and 39.

The oscillating members 45 and 47 are elongated as shown in FIGS. 7A and 7B, and with middle portions in contact with the cams 41 and 43, each have one end thereof (an end part on a side closer to the heat roller 11) oscillatably fitted to the frame 25 (coupling plate 31). As a result, the oscillating members 45 and 47 oscillate in accordance with the rotation of the rotary shaft 35.

The cams 41 and 43 are eccentric cams which are eccentric with respect to the axis of the rotary shaft 35, and a contacting portion between the outer circumferential surfaces of the cams 41 and 43 and the oscillating members 45 and 47 approaches to and separates from the axis of the rotary shaft 35.

The coupling members 49 and 51 couple together another ends of the oscillating members 45 and 47 and end parts (another end parts) on a side on which the press roller 13 is fitted from the fixation portions in the moving members 37 and 39.

Consequently, upon approach of the position of contact between the outer circumferential surfaces of the cams 41 and 43 and the oscillating members 45 and 47 to the axis of the rotary shaft 35 as a result of the rotation of the rotary shaft 35, the another end parts of the moving members 37 and 39 approach the heat roller 11 side, and a force with which the press roller 13 presses the heat roller 11 increases. On the contrary, upon separation of the position of contact between the outer circumferential surfaces of the cams 41 and 43 and the oscillating members 45 and 47 from the axis of the rotary shaft 35 as a result of the rotation of the rotary shaft 35, the another end parts of the moving members 37 and 39 separate from the heat roller 11, and the force with which the press roller 13 presses the heat roller 11 decreases.

Note that when the recording paper is supplied to the nip part, the rotary shaft 35 stops in a state in which the contact position is located closely to the axis of the rotary shaft 35, and when the recording paper is discharged from the nip part after completion of fixation of the recording paper, the rotary shaft 35 rotates and stops in a state in which the contact position is located away from the axis of the rotary shaft 35. Directions in which the rotary shaft 35 rotates when the recording paper is supplied and when it is discharged may be fixed or may be reversed therebetween.

The pressing part 33 includes the load generating member which generates a load in a direction in which the oscillating members 45 and 47 are caused to abut on the outer circumferential surfaces of the cams 41 and 43. Here, the load generating member are compression springs 53 and 55.

The shutter 23, as shown in FIGS. 8A and 8B, is formed of a plate member supported in a manner such as to be slidable along the coupling plate 31. The shutter 23 slides in a guide groove 63 of a guide plate 61 provided at the coupling plate 31. The guide plate 61 is provided at the coupling plate 31 orthogonally thereto.

The support of the shutter 23 is, for example, performed by a first locking part 65 which locks on a top surface of the guide plate 61 at a middle portion in a moving direction of the shutter 23 and by a second locking part 67 which locks on a top end of the shutter 23.

The opening and closing of the shutter 23 are performed through sliding in accordance with the rotation of the rotary shaft 35. The rotary shaft 35 is arranged in parallel to the heat roller 11 as shown in FIGS. 5A, 5B, 6A, and 6B. That is, the rotary shaft 35 is arranged along a wall (coupling plate 31) at which the detection hole 21B is formed.

The shutter 23 has an engaging part 73 engaging with a projection part 71 provided in a screw form on the rotary shaft 35. As a result, the shutter 23 moves in accordance with the rotation of the rotary shaft 35 (that is, in accordance with the supply and discharge of the recording paper).

3. Operation

Operation performed from the supply of the recording paper to the discharge thereof will be described. A state before the recording paper is supplied is a state of FIG. 7B, and a state in which the oscillating members 45 and 47 are separated from the axis of the rotary shaft 35.

(1) At time of Supply of Recording Paper

Approach of the recording paper to the nip part rotates the rotary shaft 35. In accordance with this rotation, the oscillating members 45 and 47 oscillate in a manner such that the point of contact between the outer circumferential surfaces of the cams 41 and 43 and the oscillating members 45 and 47 approaches the axis of the rotary shaft 35 (see FIG. 7A).

As a result of this oscillation, the moving members 37 and 39 are caused by the coupling members 49 and 51 to approach the heat roller 11 side, and the press roller 13 presses the heat roller 11.

On the other hand, as a result of the rotation of the rotary shaft 35, the engaging part 73 of the shutter 23 is threaded to the projection part 71 of the rotary shaft 35, and thus the shutter 23 moves and the detection hole 21B is opened as shown in FIG. 8A. As a result, through the detection hole 21B, an inner temperature, for example, the temperature of the heat roller 11 can be detected by the temperature sensor 70.

As described above, the shutter 23 opens the detection hole 21B in accordance with the supply of the recording paper, and thus compared to a case where it is constantly open, inner heat loss can be reduced. Moreover, a mechanism of opening and closing the shutter 23 utilizes the rotary shaft 35 forming the pressing part 33 which presses the press roller 13 against the heat roller 11, thus making it possible to carry it out easily at low costs.

In view of the reduced heat loss inside of the fixing device 2, the shutter 23 had better always close the detection hole 21B, in which case the inner temperature detection cannot be performed by the temperature sensor 70. In this embodiment, it is one of objects to reduce the heat loss caused by opening the detection hole 21B as much as possible while making it possible to detect the inner temperature by the temperature sensor 70.

For example, in a fixing device simply having a detection hole, the detection hole is kept open, thus causing a problem that a warmth retention force in a housing is lost. With the fixing device 2 and the image forming apparatus 1 according to this embodiment, however, the heat loss can be suppressed by the aforementioned detection hole 21B which is opened and closed by the shutter 23.

(2) At time of Discharge of Recording Paper

Upon separation of the recording paper, which has already went through fixation, from the nip part, the rotary shaft 35 rotates in a direction opposite to that at the time of the discharge of the recording paper. In accordance with this rotation, the oscillating members 45 and 47 oscillate in a manner such that the point of contact between the outer circumferential surfaces of the cams 41 and 43 and the oscillating members 45 and 47 separate from the axis of the rotary shaft 35 (see FIG. 7B).

As a result of this oscillation, the another end parts of the moving members 37 and 39 are separated from the heat roller 11 by the coupling members 49 and 51, whereby the pressing of the press roller 13 against the heat roller 11 is released.

On the other hand, as a result of the rotation of the rotary shaft 35, the shutter 23 moves in a direction opposite to that at the time of discharge of the recording paper, whereby the detection hole 21B is closed as shown in FIG. 8B. This can suppress the inner heat loss.

MODIFIED EXAMPLE

The fixing device and the image forming apparatus according to this embodiment have been described above, but this disclosure should not be limited to the embodiment described above, and thus may be, for example, a modified example as described below. Moreover, the embodiment and the modified example or modified examples may be combined together.

Moreover, even an example not described in the embodiment or the modified examples and a design change without departing from the spirits of this disclosure may be included in this disclosure.

1. Shutter Opening and Closing

In the embodiment, the rotary shaft 35 of the pressing part 33 is used to open and close the shutter 23, but a mechanism of opening and closing the shutter in accordance with the supply of the recording paper may be separately provided from the rotary shaft. For example, a new rotary shaft may be used separately from the rotary shaft of the pressing part. Note that using components forming the pressing part 33 can better prevent an increase in the number of components.

For the opening and closing, a screw mechanism of the rotary shaft 35 is used, but another mechanism, for example, a gear mechanism such as a rack and a pinion or such a mechanism which winds a wire attached to the shutter may be used.

The shutter slides at time of opening and closing, but the opening and closing may be performed in a different movement method. Permitted as the different movement method may be a method of rotating a blade (shutter) fitted to the rotary shaft. In this case, it can be carried out by using, for example, a step motor to achieve rotation through a predetermined angle or by using, for example, the rotary shaft and an umbrella gear to rotate the rotary shaft.

2. Inner Property of Housing

In the embodiment, the temperature in the housing (the temperature of the heat roller) is detected, but any different properties may be detected. The different property includes, for example, a rotation speed and humidity of the heat roller.

3. Pressing Part

Used in the embodiment is the pressing part having a structure such that the moving members are coupled to the oscillating members which use the cams, but any different pressing parts may be used. Used as the different pressing part can be, for example, a cylinder or an electric magnet which performs absorption and repelling by energization.

The compression springs are used for adjusting the pressing of the oscillating members against the cams and the force of pressing the pressure-contacting member against the heat transfer member, but a tensile spring may be used. Shapes of the oscillating members and the moving members described in the embodiment may be each one example, and may be in different shapes.

4. Heat source

In the embodiment, the heat source is arranged inside the heat transfer member, but the heat source may be arranged outside of the heat transfer member.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A fixing device comprising:

a heat source;

a heat transfer member being heated by the heat source;

a pressure-contacting member being in pressure-contact with the heat transfer member; and a housing storing the heat source, the heat transfer member, and the pressure-contacting member, and is formed with a detection hole for detecting inner property from outside, wherein the fixing device heats recording paper passing through between the heat transfer member and the pressure-contacting member to fix a toner image on the recording paper, the fixing device further comprises a shutter opening and closing the detection hole in accordance with supply of the recording paper to a nip part by the heat transfer member and the pressure-contacting member, a temperature sensor disposed outside of the housing, and detecting a temperature of the heat transfer member stored in the housing, and a pressing part moving and pressing the pressure-contacting member against the heat transfer member when the recording paper is supplied between the heat transfer member and the pressure-contacting member, wherein the property is the temperature of the heat transfer member, the temperature sensor detects through the detection hole the temperature of the heat transfer member stored in the housing, and the pressing part operates interlocking with the opening and closing of the shutter.

2. The fixing device according to claim 1, wherein the pressing part includes:

a rotary shaft extending in a direction in which the pressure-contacting member extends;

a driving source rotating the rotary shaft;

a cam being co-rotatably provided at the rotary shaft; and a moving member being pivoted by a pressing of the cam when the cam rotates, and moving the pressure-contacting member by the pivot from a position separated from the heat transfer member to a position abutting on the heat transfer member, and the shutter performs moving operation of opening and closing the detection hole by a rotational driving force supplied from the rotary shaft at time of the rotation of the rotary shaft.

3. The fixing device according to claim 2, wherein the pressing part further includes an oscillating member oscillating while abutting on an outer circumferential surface of the cam, and the cam presses and thereby pivots the moving member with the oscillating member in between.

4. The fixing device according to claim 2, wherein the pressing part presses the pressure-contacting member against the heat transfer member by a pressing amount predefined in accordance with a thickness of the recording paper.

5. The fixing device according to claim 2, wherein the moving member is provided with a load generating member generating a pressing force for moving the pressure-contacting member towards the heat transfer member.

6. The fixing device according to claim 2, wherein the rotary shaft extends in the direction in which the pressure-contacting member extends, and is arranged along a wall portion of the housing, on which the detection hole is formed, the shutter is a plate-like member movably supported along the wall portion, having a engaging part threaded to a projection part provided at the rotary shaft, and the rotational driving force is transmitted from the projection part to the engaging part when the rotary shaft rotates.

7. An image forming apparatus comprising:

an image formation section performing an image formation on recording paper, and the fixing device according to claim 1 performing the fixing operation on the recording paper, on which the image formation section has been performed the image formation.

* * * * *